US005868398A

United States Patent [19]

Maier et al.

[11] Patent Number: 5,868,398

[45] Date of Patent: Feb. 9, 1999

[54] GAS TURBINE STATOR VANE SEAL

[75] Inventors: M. Stefan Maier, Cape Neddick, Me.; Jeffrey S. Taylor, Palm Beach Gardens, Fla.

[73] Assignee: United Technologies Corporation, Hartford, Conn.

[21] Appl. No.: 859,237

[22] Filed: May 20, 1997

[51] Int. Cl.[6] ..... F16J 15/02

[52] U.S. Cl. ..... 277/643; 277/647; 277/650; 415/135; 415/139; 415/191

[58] Field of Search ..... 277/579, 580, 277/643, 650, 641, 647; 415/135, 139, 191, 170.1, 174.2

[56] References Cited

U.S. PATENT DOCUMENTS

| | | | |
|---|---|---|---|
| 3,144,255 | 8/1964 | Thorne et al. | 277/173 |
| 3,728,041 | 4/1973 | Bertelson | 415/189 |
| 3,938,906 | 2/1976 | Michel et al. | 415/139 |
| 4,114,248 | 9/1978 | Smith et al. | 29/460 |
| 4,524,980 | 6/1985 | Lillibridge et al. | 277/199 |
| 4,537,024 | 8/1985 | Grosjean | 60/39.161 |
| 4,897,021 | 1/1990 | Chaplin et al. | 415/173.7 |
| 5,154,577 | 10/1992 | Kellock et al. | 415/170.1 |
| 5,338,152 | 8/1994 | Feldman | 415/139 |

*Primary Examiner*—Harry C. Kim
*Assistant Examiner*—Gary Grafel
*Attorney, Agent, or Firm*—Richard D. Getz

[57] ABSTRACT

A seal for stator vane segments within a gas turbine engine is provided which includes an axial member and an end member. The axial member includes a central portion and at least one axial joint element extending out from the central portion. The central portion has across-section which includes a pair of substantially u-shaped circumferential ends connected by an arcuate midsection. The axial joint element transitions from the arcuate midsection to a substantially flat end. The end member includes an end joint element attached to a radial portion. The axial and end joint elements contact each other to prevent leakage therebetween, and also sidably cooperate with each other to accommodate misalignment between the axial member and the end member.

4 Claims, 2 Drawing Sheets

FIG. 1
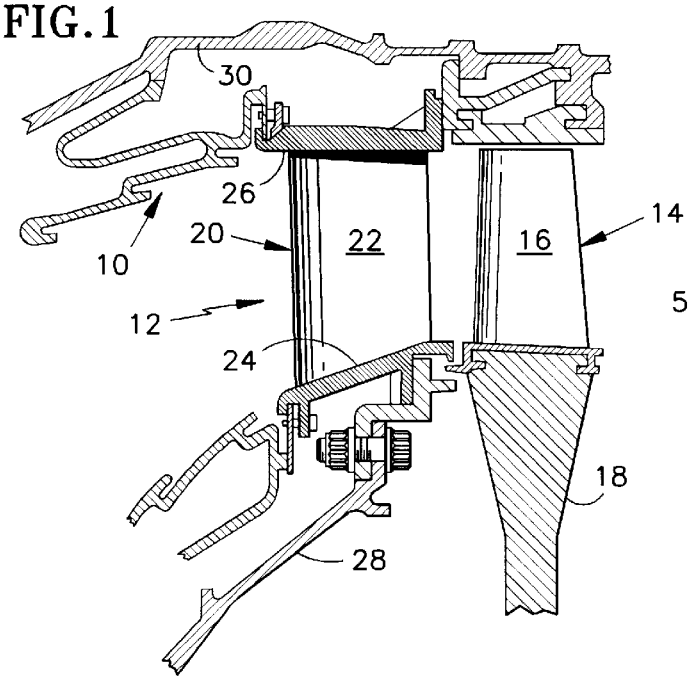
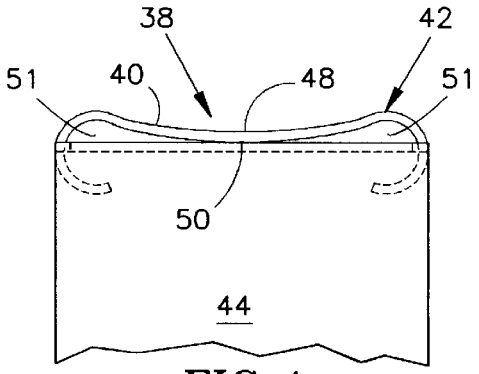
FIG. 4
Prior Art
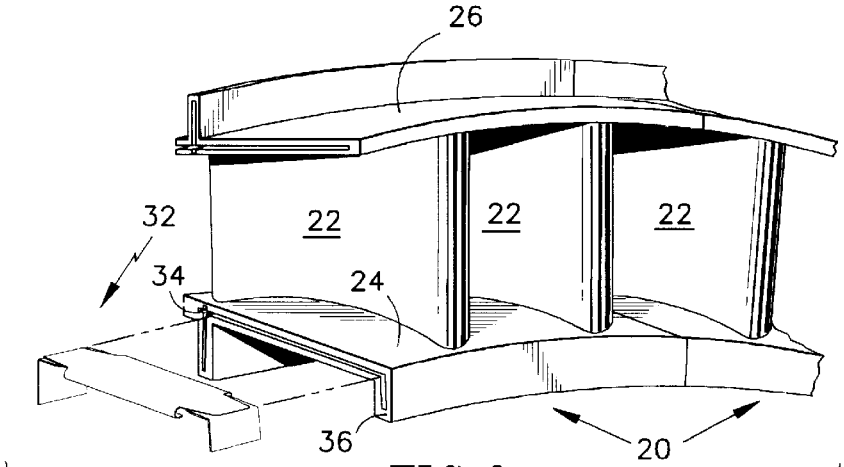
FIG. 2
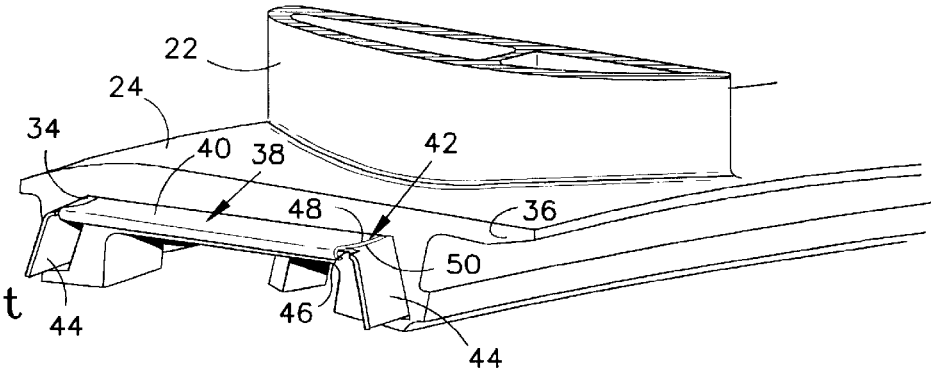
FIG. 3
Prior Art FIG.5
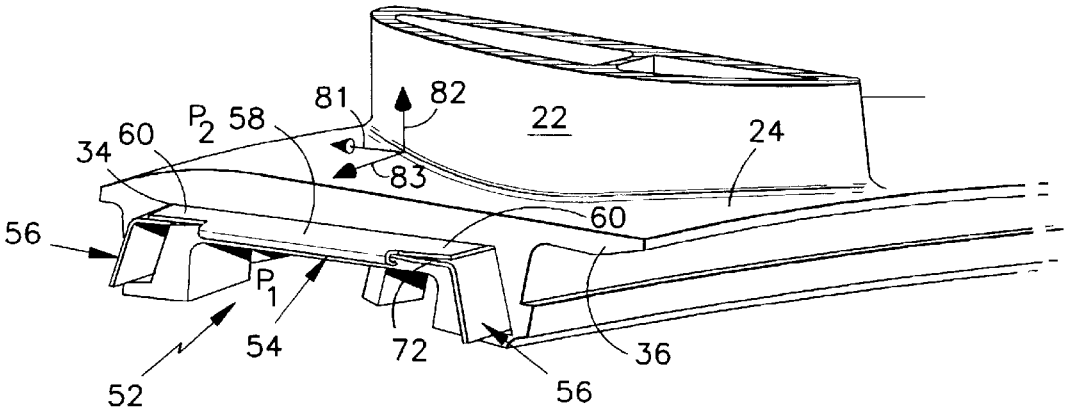
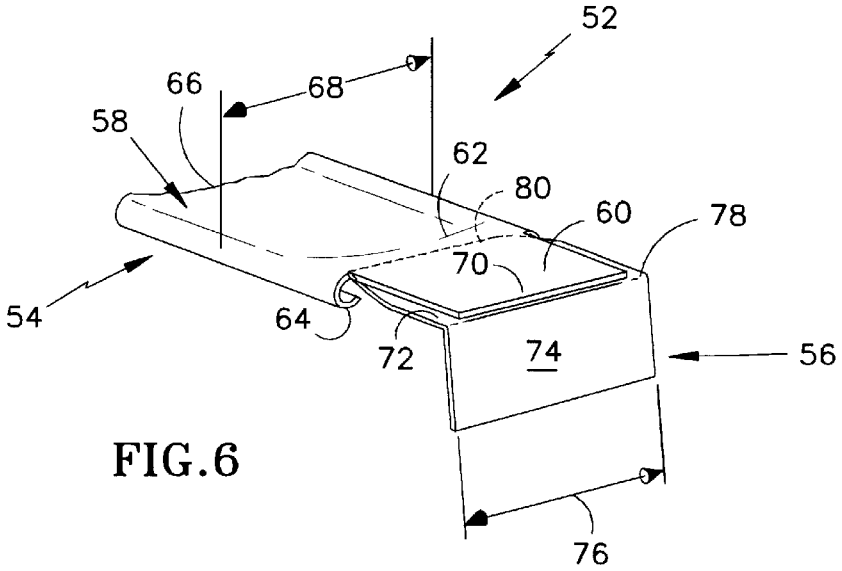
FIG.6
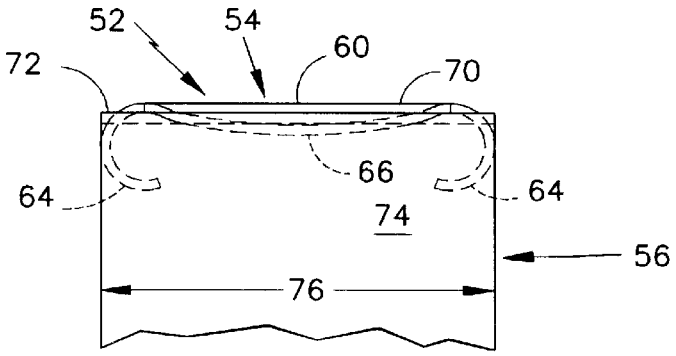
FIG.7

GAS TURBINE STATOR VANE SEAL

The invention was made under a U.S. Government contract and the Government has rights herein.

BACKGROUND OF THE INVENTION

1. Technical Field

This invention relates to seals within gas turbine engines in general, and to seals for sealing between stator vane segments, in particular.

2. Background Information

Rotor assemblies within most modern gas turbine engines typically include a number of rotor stages separated by stator sections. Each rotor stage generally includes a plurality of blades circumferentially distributed around a disk. Each blade consists of a root, an airfoil, and a platform extending laterally outward between the root and the airfoil. The roots are received within the disk and the platforms collectively form an annular surface at the bases of the airfoils. The stator sections adjacent the rotor sections generally include a plurality of segments that collectively form an annular assembly. Each segment includes one or more vanes extending between an inner and an outer platform. The inner platforms are attached to a static support structure and the outer platforms are supported by the casing disposed radially outside of the stator section. The inner and outer platforms collectively form gas path boundaries through the stator section.

To avoid, or minimize, leakage between stator segments, it is known to provide seals between the inner and outer platforms of adjacent segments. Most inter-segment seals extend axially between segments from forward to aft, and radially along one or both of the forward and aft edges of the segment. Slots machined in circumferential faces (axially and radially extending surfaces) of the segments receive the inter-segment seals.

Inter-segment seals having either a flat plate-like cross-section or a "dog-bone" cross-section are among the most popular. Flat inter-segment seals are often made from sheet metal and may be referred to as "feather seals". The flat geometry offers great flexibility to accommodate misalignment between adjacent stator vane segments. In some instances, however, the flexibility gained by the flat geometry compromises the seals ability to seal between segments.

"Dog-bone" cross-section seals (sometimes referred to as "hour-glass" seals) on the other hand, provide nearly as much flexibility as featherseals and more efficient sealing. A "dog-bone" seal may be described as having a cross-section that includes a pair of substantially u-shaped circumferential ends connected by an arcuate midsection. The u-shaped circumferential ends are received within the slots of adjacent stator vane segments and the arcuate midsection bridges the gap between the adjacent stator vane segments. The convex side of the arcuate midsection extends outwardly toward the higher of the two pressure regions across the seal. The higher pressure deflects the arcuate midsection, consequently biasing the u-shaped circumferential ends within the slots of the stator vane segments. A disadvantage of "dog-bone" type seals is that the cross-sectional geometry precludes a single piece being used for both the axial portion and the radial portion(s) of the stator vane segment seal slot.

What is needed is an apparatus for sealing between stator segments of a gas turbine engine that provides an appropriate amount of flexibility, one that efficiently seals both radially and axially, and one that can be readily manufactured.

DISCLOSURE OF THE INVENTION

It is, therefore, an object of the present invention to provide an apparatus for sealing between stator vane segments of a gas turbine engine that provides an appropriate amount of flexibility.

It is another object of the present invention to provide an apparatus for sealing between stator segments of a gas turbine engine that seals radially and axially in an efficient manner.

According to the present invention a seal for stator vane segments within a gas turbine engine is provided which includes an axial member and an end member. The axial member includes a central portion and at least one axial joint element extending out from the central portion. The central portion has a cross-section which includes a pair of substantially u-shaped circumferential ends connected by an arcuate midsection. The axial joint element(s) transitions from the arcuate midsection to a substantially flat end. The end member includes an end joint element attached to a radial portion. The axial and end joint elements contact each other to prevent leakage therebetween, and also slidably cooperate with each other to accommodate misalignment between the axial member and the end member.

An advantage of the present invention is that a flexible seal for sealing between stator vane segments of a gas turbine engine is provided. Specifically, the joint formed between the axial member and each end member accommodates circumferential, radial and axial movement, thereby minimizing the formation of undesirable leak paths between the axial and end members.

Another advantage of the present invention is that an improved inter-segment stator vane seal is provided. The present invention seal minimizes the leak path area between the axial and the radial members and thereby minimizes the amount of leakage between the adjacent stator vane segments.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 is a diagrammatic partial side view of a gas turbine engine, showing a combustor, stator vane assembly, and a rotor assembly.

FIG. 2 is a diagrammatic partial perspective of a stator vane assembly, showing an apparatus for sealing between adjacent stator vane segments.

FIG. 3 is a diagrammatic view of a prior art apparatus for sealing between adjacent stator vane segments, shown installed in a stator vane segment.

FIG. 4 is an end view of a prior art apparatus for sealing between adjacent stator vane segments.

FIG. 5 is a diagrammatic perspective view of the present invention apparatus for sealing between adjacent stator vane segments, shown installed in a stator vane segment.

FIG. 6 is a diagrammatic perspective partial view of the present invention apparatus for sealing between adjacent stator vane segments.

FIG. 7 is an end view of the present invention apparatus for sealing between adjacent stator vane segments.

BEST MODE FOR CARRYING OUT THE INVENTION

Referring to FIG. 1, a gas turbine engine includes a combustor 10, a stator assembly 12, and a rotor assembly 14.

The rotor assembly 14 includes a plurality of blades 16 attached to a disk 18. The stator assembly 12 includes a plurality of segments 20 that collectively form an annular structure. Each segment 20 includes one or more vanes 22 extending between an inner 24 and an outer 26 platform. The inner platforms 24 are attached to a static support structure 28 and the outer platforms 26 are attached to the casing 30 disposed radially outside of the stator assembly 12. The inner 24 and outer 26 platforms collectively form boundaries for the gas path through the stator assembly 12.

Referring to FIGS. 2–4, seals 32 are disposed in the inner platforms 24 of adjacent stator vane segments. The seals 32 are received within slots 34 machined in the circumferential faces 36 of the adjacent stator vane segments 20. FIGS. 3 and 4, show a prior art seal 38 received in a slot 34 disposed in a circumferential face 36 of a stator vane segment 20. The prior art seal 38 has an axial member 40 having a "dog-bone" cross-section 42 and two radially extending end members 44. The axial member 40 extends nearly the entire length of the axial portion of the slot 34. Each end member 44 includes a tab 46 received within the dog-bone cross-section 42. The arcuate midsection 48 of the dog-bone cross-section 42 causes the tab 46 of the end member 44 to contact only the apex 50 of the arcuate midsection 48, consequently leaving leak paths 51 on either side.

Referring to FIGS. 5–7, the present invention seal 52 is shown received in a slot 34 disposed in a circumferential face 36 of a stator vane segment 20. The seal 52 includes an axial member 54 and a pair of end members 56, although a single end member 56 may be adequate depending upon the application. The axial member 54 includes a central portion 58 and an axial joint element 60 extending out from each axial end 62 of the central portion 58 to be engaged with an end member 56. The cross-section of the central portion 58 (see FIGS. 6 and 7) includes a pair of substantially u-shaped circumferential ends 64 connected by an arcuate midsection 66. Each axial joint element 60 transitions from the arcuate midsection 66 to a substantially flat axial end 70.

Each end member 56 includes a end joint element 72 attached to a radial portion 74, the latter 74 extending radially away from end joint element 72. The radial portion 74 has a width 76 substantially equal to that of the central portion 58 of the axial member 54. In the preferred embodiment, each end joint element 72 tapers inwardly from the end 78 adjacent the radial portion 74 to an edge 80 opposite the radial portion 74. The inward taper causes the width 76 of the end joint element 72 to be greater at the radial portion end 78 than at the opposite edge 80.

Referring to FIGS. 2, 5, and 6, in the operation of the present invention seal 52, the seal 52 is disposed between adjacent stator vane segments 20 (see FIG. 2). The relative proximity of the stator vane segments 20 maintains the seal 52 in the slots 34 of the adjacent segments 20. One of the end elements 56 is positioned adjacent each end of the axial member 54. Specifically, the end joint element 72 is disposed radially inside of, and in contact with, the axial joint element 60. The axial member 54 and the end members 56 can axially slide, relative to one another, to accommodate axial positioning within the slots 34 of either stator vane segment 20. Axial 81, radial 82, or circumferential 83 (see FIG. 5) misalignment between the adjacent stator vane segments 20 is accommodated by the axial joint element(s) 60 and the end joint elements(s) 72 slidably cooperating with each other. The joint elements "cooperating" with each other may also be described as slidably pivoting relative to one another. Hence, the joint formed between the axial member 54 and the end member 56 has three degrees of freedom.

A pressure difference across the seal 52 biases the seal 52 within the slots 34 and the end joint elements 72 into contact with the axial joint elements 60. Specifically, a first pressure ($P_1$) radially inside of the seal 52 is greater than a second pressure ($P_2$) radially outside the seal 52 ($P_1>P_2$). The difference in pressure causes the arcuate midsection 66 to deflect, consequently causing the u-shaped circumferential ends 64 to extend further into the slots 34. The difference in pressure also causes the end joint elements 72 to remain in contact with the axial joint elements 60. As can be seen in FIG. 7, the transition of the axial joint elements 60 from the arcuate midsection 66 to the substantially flat axial end 70 provides a sealing surface that: (1) readily mates with the end joint element 72, thereby avoiding leak paths found in the prior art; and (2) accommodates misalignment between adjacent stator vane segments 20 by allowing relative motion.

Although this invention has been shown and described with respect to the detailed embodiments thereof, it will be understood by those skilled in the art that various changes in form and detail thereof may be made without departing from the spirit and scope of the claimed invention.

We claim:

1. A seal for stator vane segments within a gas turbine engine, comprising:

an axial member, having a central portion and a first axial joint element extending out from said central portion, said central portion having a cross-section which includes a pair of substantially u-shaped circumferential ends connected by an arcuate midsection, said first axial joint element transitioning from said arcuate midsection to a substantially flat end; and a first end member, having a first end joint element and a radial portion, wherein said first axial joint element and said first end joint element contact each other to seal therebetween, and slidably cooperate with each other to accommodate misalignment between said axial member and said first end member.

2. A seal for stator vane segments according to claim 1, wherein said first end joint element tapers inward to facilitate relative motion between said axial member and said first end member.

3. A seal for stator vane segments according to claim 1, further comprising:

a second axial joint element extending out from an edge of said central portion opposite said first axial joint element, said second axial joint element transitioning from said arcuate midsection to a substantially flat edge; and a second end member, having a second end joint element and a radial portion, wherein said second axial joint element and said second end joint element contact each other to seal therebetween, and slidably cooperate with each other to accommodate misalignment between said axial member and said second end member.

4. A seal for stator vane segments according to claim 3, wherein said second end joint element tapers inward to facilitate relative motion between said axial member and said second end member.

* * * * *